US009591916B2

(12) United States Patent
Kim

(10) Patent No.: US 9,591,916 B2
(45) Date of Patent: Mar. 14, 2017

(54) ASSEMBLY TECHNOLOGY FOR ANY SHAPE DISK BRUSH

(71) Applicant: AA R&D LLC, Leonia, NJ (US)

(72) Inventor: Yoon-Hoi Kim, Fort Lee, NJ (US)

(73) Assignee: AA R&D LLC, Leonia, NJ (US)

( * ) Notice: Subject to any disclaimer, the term of this patent is extended or adjusted under 35 U.S.C. 154(b) by 0 days.

(21) Appl. No.: 14/808,057

(22) Filed: Jul. 24, 2015

(65) Prior Publication Data

US 2015/0335133 A1 Nov. 26, 2015

Related U.S. Application Data

(60) Provisional application No. 62/155,600, filed on May 1, 2015.

(51) Int. Cl.
*A45D 40/26* (2006.01)
*A46B 9/02* (2006.01)

(52) U.S. Cl.
CPC ..... *A46B 9/021* (2013.01); *A46B 2200/1053* (2013.01)

(58) Field of Classification Search
CPC ..... A45D 40/262; A46B 3/00; A46B 3/10; A46B 2200/01; A46B 2200/1046; A46B 2200/1053; A46B 3/106; A46B 9/021
See application file for complete search history.

(56) References Cited

U.S. PATENT DOCUMENTS

| | | | | |
|---|---|---|---|---|
| 3,329,998 | A | 7/1967 | Stohr | |
| 6,260,558 | B1 | 7/2001 | Neuner | |
| 8,919,351 | B1 | 12/2014 | Wang | |
| 2002/0014251 | A1* | 2/2002 | Gueret | A45D 40/267 132/218 |
| 2009/0194128 | A1* | 8/2009 | Vandromme | A46B 3/18 132/218 |
| 2010/0037911 | A1 | 2/2010 | Kim | |
| 2011/0088712 | A1 | 4/2011 | Pires et al. | |

OTHER PUBLICATIONS

Notification of Transmittal of the International Search Report and the Written Opinion of the International Searching Authority, or Declaration (Form PCT/ISA/220) issued in counterpart International Application No. PCT/US15/41907 dated Oct. 23, 2015, with Forms PCT/ISA/210 and PCT/ISA/237 (13 pages).

* cited by examiner

*Primary Examiner* — Rachel Steitz
(74) *Attorney, Agent, or Firm* — Westerman, Hattori, Daniels & Adrian, LLP

(57) ABSTRACT

A cosmetic applicator brush including a plurality of discs assembled relative to one another with each disc having a body with a plurality of bristles and/or combs extending radially therefrom. The adjacent discs are maintained at an angular relationship with respect to one another independent of a disc specific keying element.

17 Claims, 13 Drawing Sheets

ASSEMBLY TECHNOLOGY FOR ANY SHAPE DISK BRUSH

CROSS-REFERENCE TO RELATED APPLICATIONS

This application claims the benefit of U.S. Provisional Application No. 62/155,600, filed May 1, 2015, the contents of which are incorporated herein.

FIELD OF THE INVENTION

The present invention relates to a cosmetic applicator. More particularly, the present invention relates to a cosmetic applicator brush including stacked discs which are angularly offset relative to one another independent of a central rod.

BACKGROUND OF THE INVENTION

Various cosmetics are applied using an applicator brush, for example, mascara which is a kind of cosmetic that is mainly used by women. The applicator brush is a cosmetic tool for painting various colors of mascara on eyelashes in order to show aesthetic sense around eyes or for applying other cosmetics to the eyes or other areas.

With the exemplary mascara, the applicator brush is configured to be inserted into a vessel in which mascara liquid is stored, a knob for opening and closing the vessel, a rod protruded to a leading end of the knob, and a brush formed on the rod. The mascara is used by smearing the mascara liquid on the brush through the coupling or separate process of the knob and the vessel.

Meanwhile, the mascara brush formed as above is manufactured to be suitable for various functions, such as a volume for the eyelashes (volume: effect that eyebrows are seen to be affluent according to the length and form of the brush hair), curl (curl: an effect that a length of eyebrows is long), clean (clean: an effect that eyebrows are not lumped), etc. The mascara brush uniformly applies the mascara liquid having viscosity on the eyelashes and a combing function by the brush should be excellent so that the eyelashes are not coagulated.

One type of manufacture for mascara brushes is a disc brush which is manufactured with an axial rod that penetrating multiple discs in the center. In order to create a desired bristle arrangement, each successive disc is placed in angular offset compared to the disc before and after. To achieve the angular offset, a geometrical cross section or key is typically built into the rod and discs alike. Such a keyed system requires the key to be offset relative to the bristles a different amount for each disc.

SUMMARY OF THE INVENTION

In at least one embodiment, the present invention provides a cosmetic applicator brush including a plurality of discs assembled relative to one another with each disc having a body with a plurality of bristles and/or combs extending radially therefrom. The adjacent discs are maintained at an angular relationship with respect to one another independent of a disc specific keying element.

In at least one embodiment, each disc body has a first face with a projection extending therefrom and an opposed second face with an indentation defined therein. The projection and indentation are angularly offset from one another and the interaction of a projection of one disc with the indentation of an adjacent disc maintains the angular relationship between the adjacent discs.

In at least one embodiment, each disc body has two wire passages extending therethrough and a wire extends through the passages of adjacent discs to link the discs together. An amount of twist in the wire defines the angular relationship between adjacent discs. Therefore, the present invention provides a cosmetic applicator brush including a plurality of discs assembled relative to one another with each disc having a projection and an indentation and maintained at an angular relationship with respect to one another independent of a disc specific keying element. In addition, the present invention provides a cosmetic applicator brush, where each disc body is twisted by wires extending wire passages to link the discs together.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION OF THE INVENTION

Figure 1:
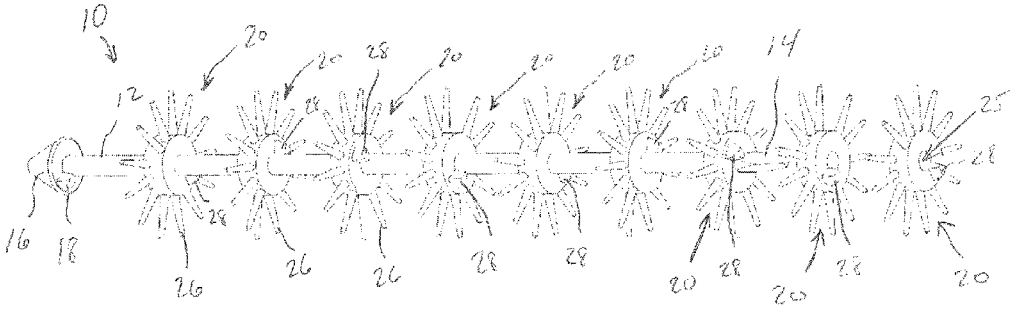
FIG. 1 is an exploded perspective view of a cosmetic applicator brush utilizing discs in accordance with an exemplary embodiment.

In the drawings, like numerals indicate like elements throughout. Certain terminology is used herein for convenience only and is not to be taken as a limitation on the present invention. The following describes preferred embodiments of the present invention. However, it should be understood, based on this disclosure, that the invention is not limited by the preferred embodiments described herein.

Figure 2:
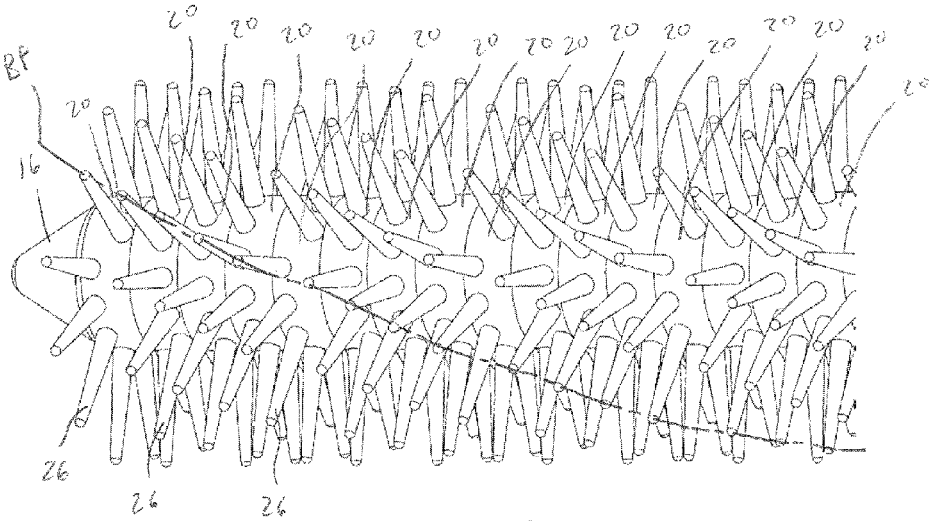
FIG. 2 is an assembled view of the cosmetic applicator brush of FIG. 1.

Referring to FIGS. 1-4, a cosmetic applicator brush 10 in accordance with an embodiment of the invention will be described. The applicator brush 10 includes a plurality of discs 20 assembled on a rod 12. In the illustrated embodiment, the rod 12 has a connection end 14, configured for connection to a knob, and a cap end 16 configured to provide a finished end to the applicator brush 10. A projection 18 extends from an inside surface of the cap end 16 and is configured to engage an indentation 30 of one of the discs 20 as explained below. While the cap end 16 of the illustrated embodiment has a projection, it is recognized that the cap end 16 may have an indentation configured to engage a projection 28 of one of the discs 20. It is noted that the rod 12 has a non-keyed configuration. Even without the rod having a keyed configuration, the discs 20 may be positioned on the rod 12 such that the bristles 26 have a desired configuration, for example, the twisted bristle path BP as illustrated in FIG. 2.

Figure 3:
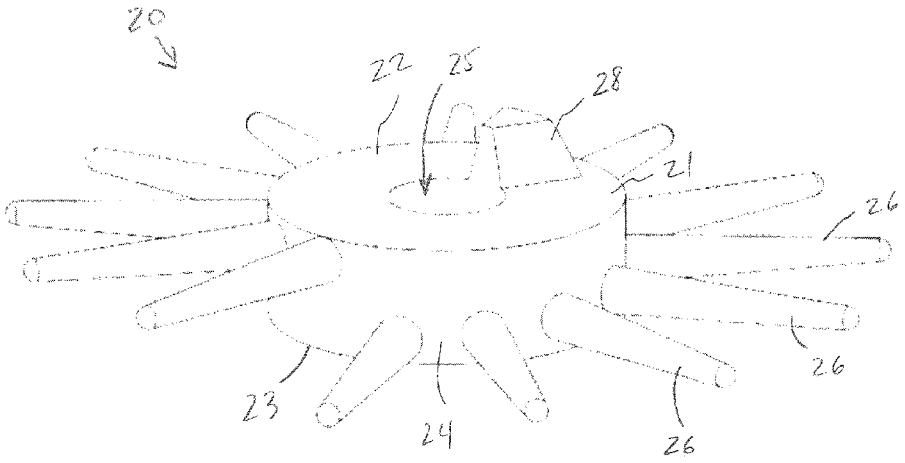
FIG. 3 is a top perspective view of an exemplary disc of the applicator brush of FIG. 1.
Figure 4:
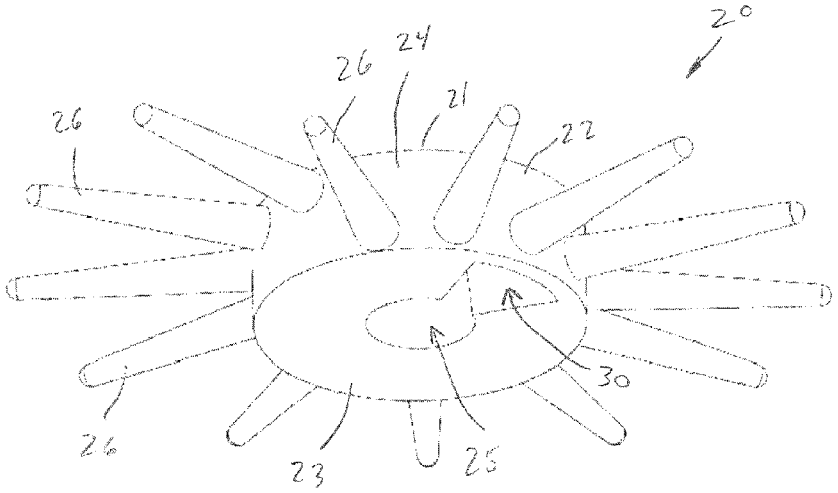
FIG. 4 is a bottom perspective view of the disc of FIG. 3.
Figure 5:
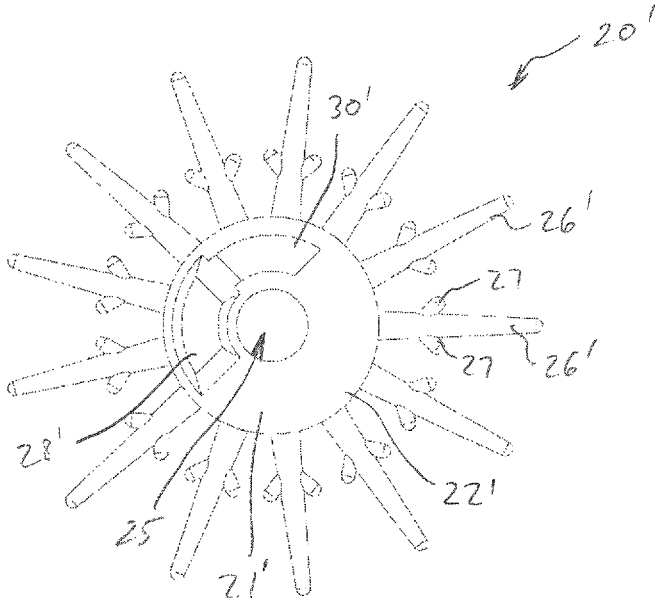
FIG. 5 is a top plan view of an exemplary disc in accordance with another embodiment of the invention.
Figure 6:
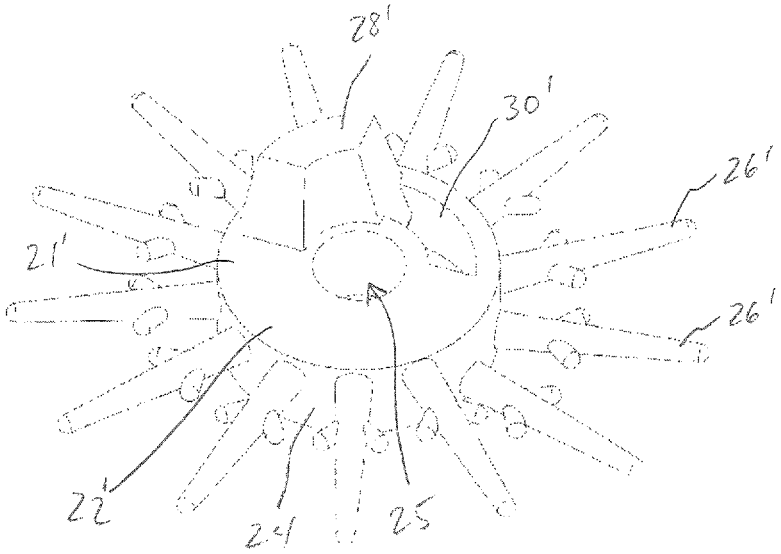
FIG. 6 is a top perspective view of the disc of FIG. 5.
Figure 7:
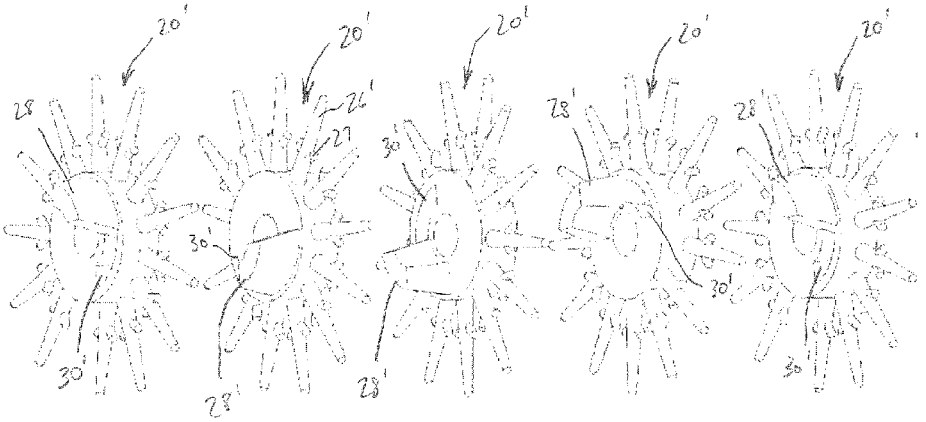
FIG. 7 is an exploded perspective view of a cosmetic applicator brush, without the central rod, utilizing discs of FIG. 5.

Referring to FIGS. 3 and 4, each disc has a disc body 22 extending between opposed faces 21 and 23 and a sidewall 24 between the faces 21, 23. Bristles 26 extend from the sidewall 24 in a desired configuration. In the illustrated embodiment, the bristles 26 extend in a spiral configuration about the body 22, but any desired configuration may be utilized. A through bore 25 extends through the body 22 such that each disc 20 may be positioned on the rod 12. Again, the through bore 25 does not have a keyed configuration.

To achieve the desired relationship between adjacent discs 20, each disc 20 has a projection 28 extending from the face 21 and an indentation 30 defined on the opposite face 23. The projection 28 and the indentation 30 are located with an angular offset relative to one another. In FIG. 3, the projection 28 has a radial axis at approximately 1 o'clock while in FIG. 4, the indentation 30 has a radial axis at approximately 5 o'clock. The angular offset defines the offset between the bristles 26 on adjacent discs 20. The angular offset can be anything from 0° to 360° and the offset may be consistent among all of the discs 20 or it may change amongst one or more of the discs to produce other desirable bristle configurations. The projections 28 and indentations 30 have complimentary configurations, for example, the illustrated trapezoidal shape, however, the invention is not limited to the illustrated shape. The complimentary shapes lock the discs 20 into each other in a designated position and maintain the desired angular offset from the previous disc and to the next discs in the stack.

Figure 8:
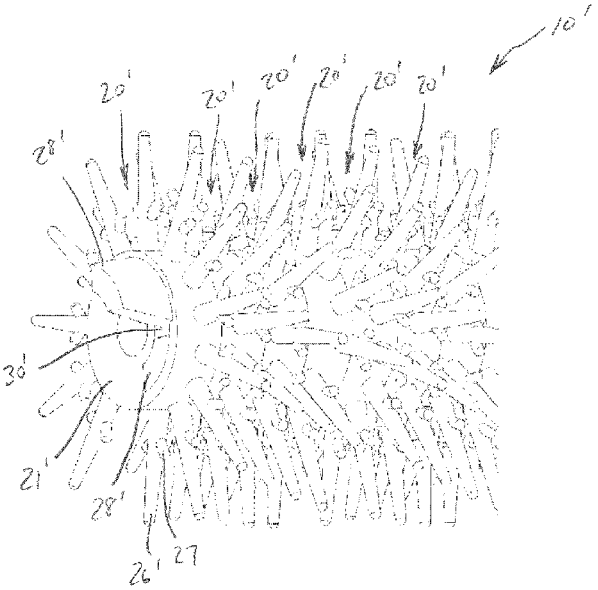
FIG. 8 is an assembled view of the cosmetic applicator brush of FIG. 7.
Figure 23:
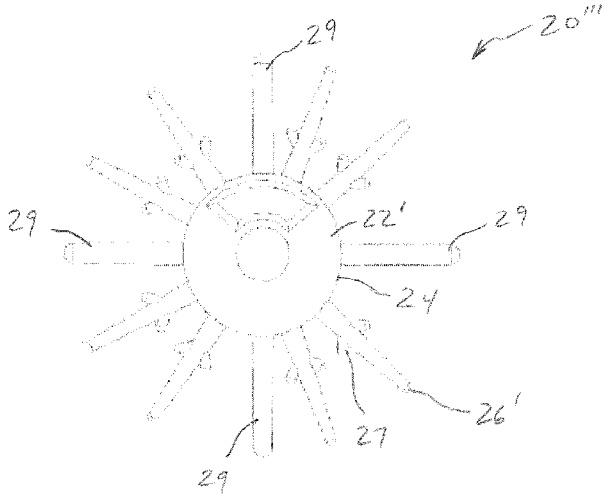
FIG. 23 is a plan view of an exemplary disc in accordance with another exemplary embodiment of the invention.
Figure 24:
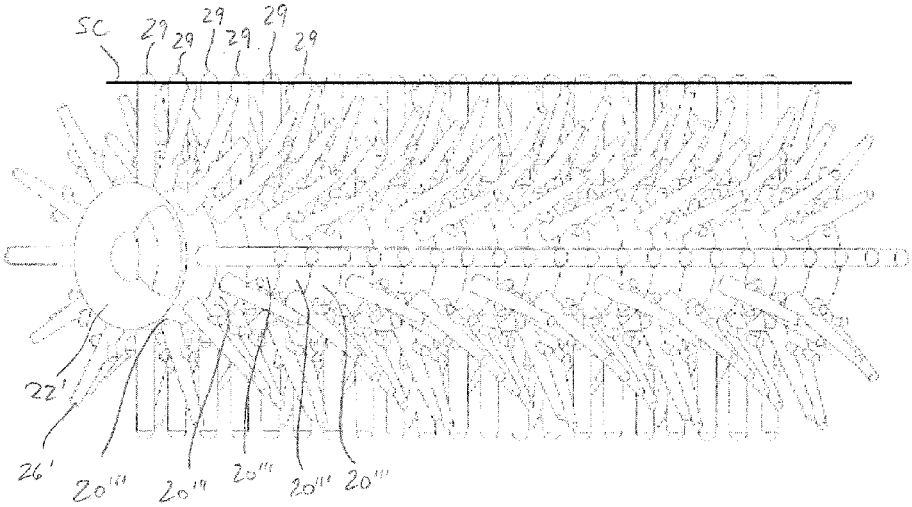
FIG. 24 is an assembled view of a cosmetic applicator incorporating the disc of FIG. 23.
Figure 25:
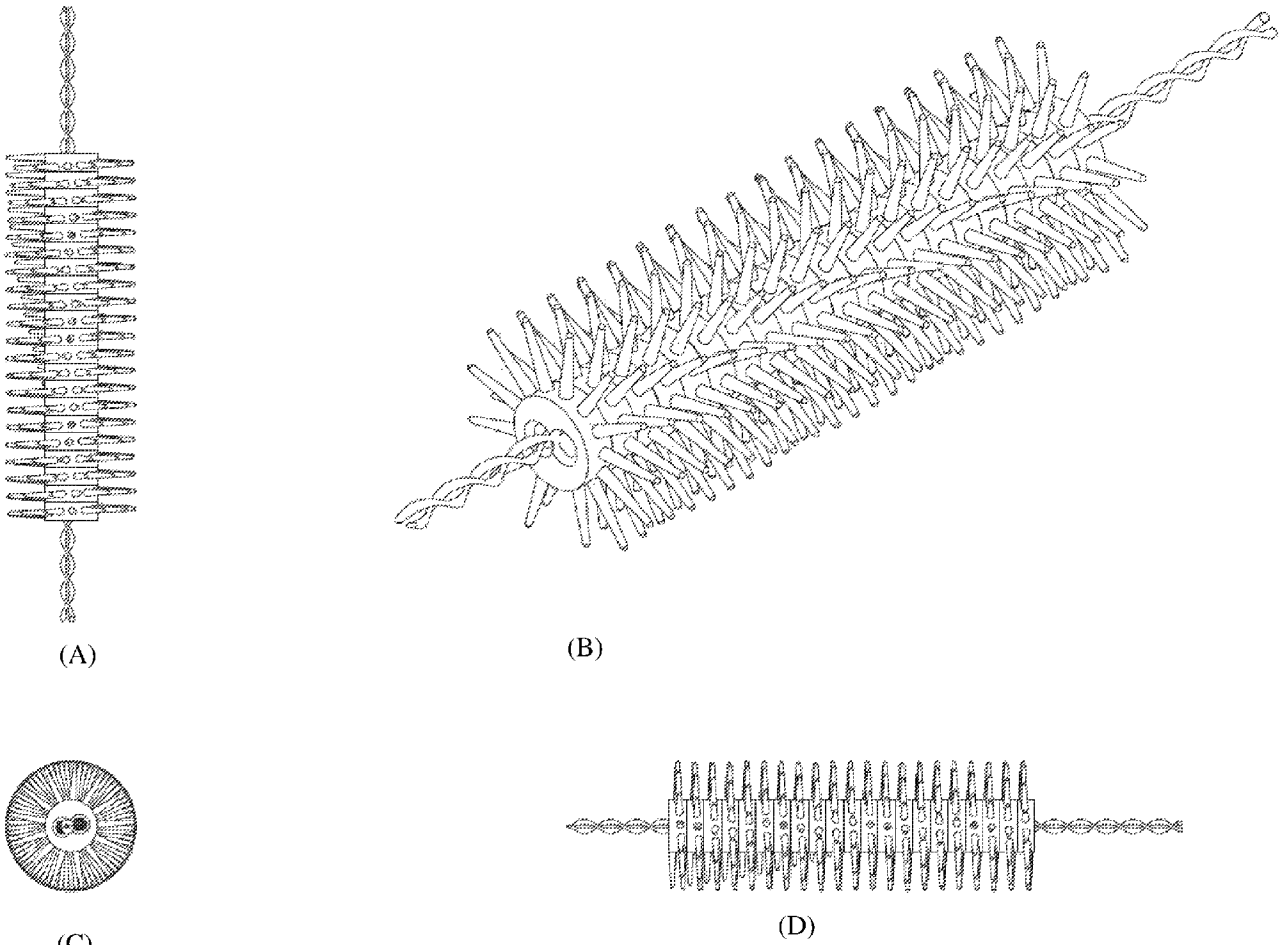
FIGS. 25(A)-(D) are assembled views of the cosmetic applicator brush of FIG. 14, where a plurality of stacked discs is interconnected to one another via a pair of wires.
Figure 26:
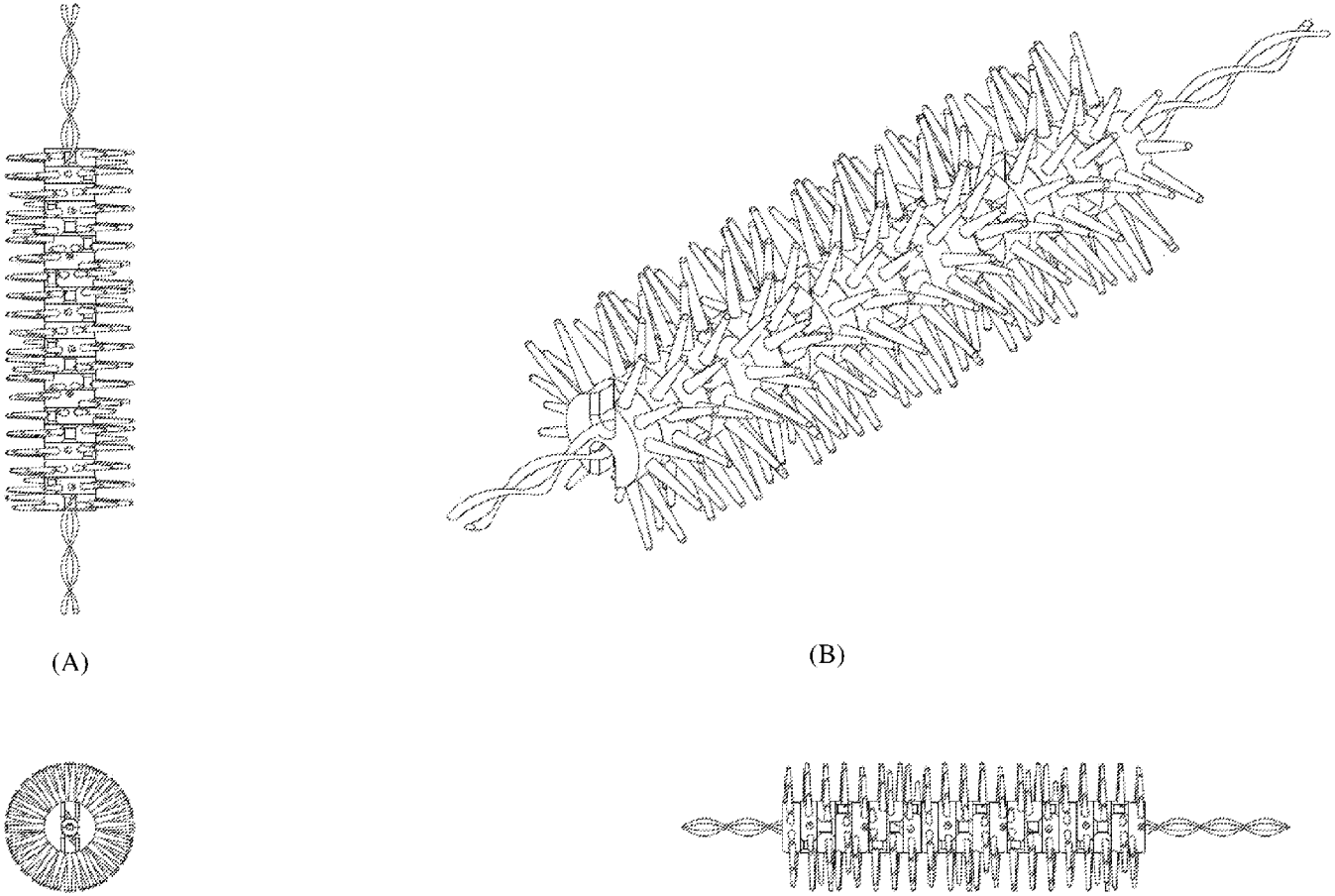
FIGS. 26(A)-(D) are assembled views of the cosmetic applicator brush of FIG. 17, where the passages through the discs extend to the outside surface of the disc body.

Referring to FIGS. 5-8, another cosmetic applicator brush 10' in accordance with an exemplary embodiment of the invention will be described. The applicator brush 10' is similar to the previous embodiment and includes a rod (not shown) extending through bores 25 of stacked discs 20'. In the present embodiment, the indentations 30' extend completely through the disc body 22' such that they open into face 21. The projections 28' each have a height equal to the height of the body 22' such that a top surface of the projection 28' is flush with the face 21' of the adjacent disc 22' when assembled, as shown in FIG. 8. It is further contemplated that one or more projections 28' may have a height larger than the height of the body 22' such that the projection 28' would extend into the indentation of a second adjacent disc. Again, the projections 28' and the indentations 30' are at an angular offset with respect to one another. It is further noted that the bristles 26' have a different configuration with secondary bristles 27 extending from the main bristles 26'. The invention is not limited to the illustrated bristles and various combinations may be utilized. As one example, the combination of bristles may include, but is not limited to, variations of size, shape, color, material, nomenclature or method of fabrication (mono-injection, bi-injection). For example, a comb may be utilized in placement of a bristle to straighten, de-clump, and possibly extend lashes during application. Referring to FIGS. 23-24 for this example, FIG. 23 shows multiple combs 29 protruding from the sidewall 24 of the body 22' of the disc 20''' replacing the respective bristles 26'. In all other respects, the disc 20''' has the configuration of the discs 20' of FIGS. 5-8. When assembled, the combs 29 will form a straight path SC as depicted in FIG. 24.

Figure 9:
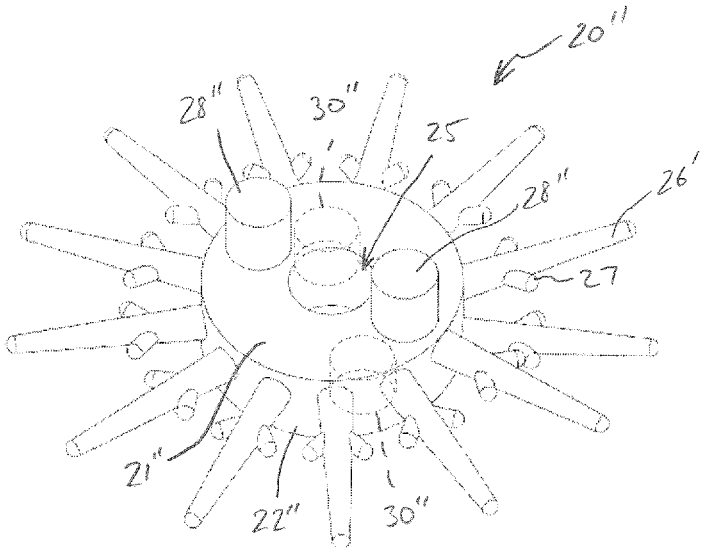
FIG. 9 is a top perspective view of an exemplary disc in accordance with another embodiment of the invention.
Figure 10:
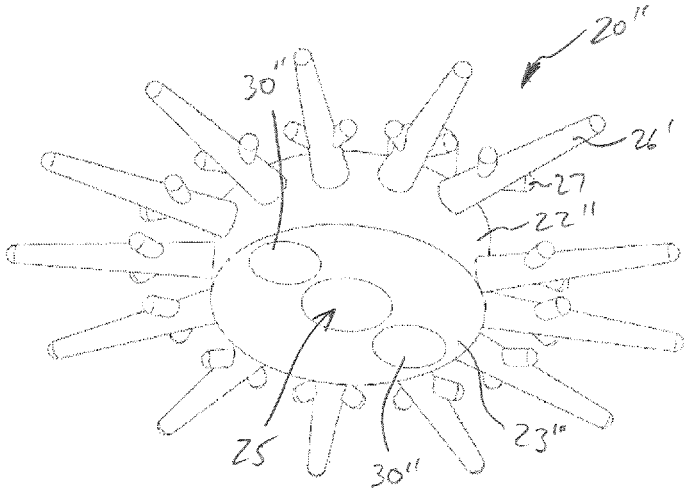
FIG. 10 is a bottom perspective view of the disc of FIG. 9.

Referring to FIGS. 9 and 10, an exemplary disc 20" in accordance with another embodiment of the invention will be described. In the present embodiment, a pair of projections 28" extend from face 21" of body 22" while a corresponding pair of indentations 30" are defined in the opposite face 23". In the present embodiment, the projections 28" and indentations 30" have complementary circular configurations. Again, the projections 28' and the indentations 30' are at an angular offset with respect to one another. In all other respects, the discs 20" may be stacked on a rod (not shown) to achieve a brush with a desired configuration.

It is further recognized that in any of the illustrated embodiments, the applicator brush may include other components other than the illustrated bristle discs. For example, a rod, comb or disc with a different bristle arrangment can be attached in the middle or end to produce a different desired shape or configuration. Additionally, while the discs are shown stacked along the rod 12, it is possible to attach the individual discs with other mechanical or chemical means, such as glue, laser or ultrasonic welding and any other similarly employed techniques while optionally employing the axial rod.

Figure 11:
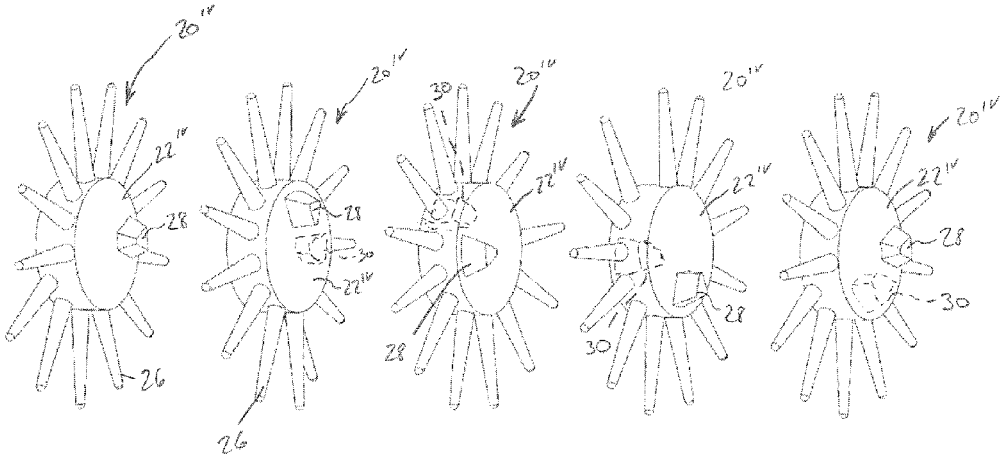
FIG. 11 is an exploded perspective view of a cosmetic applicator brush utilizing discs in accordance with another embodiment of the invention.
Figure 12:
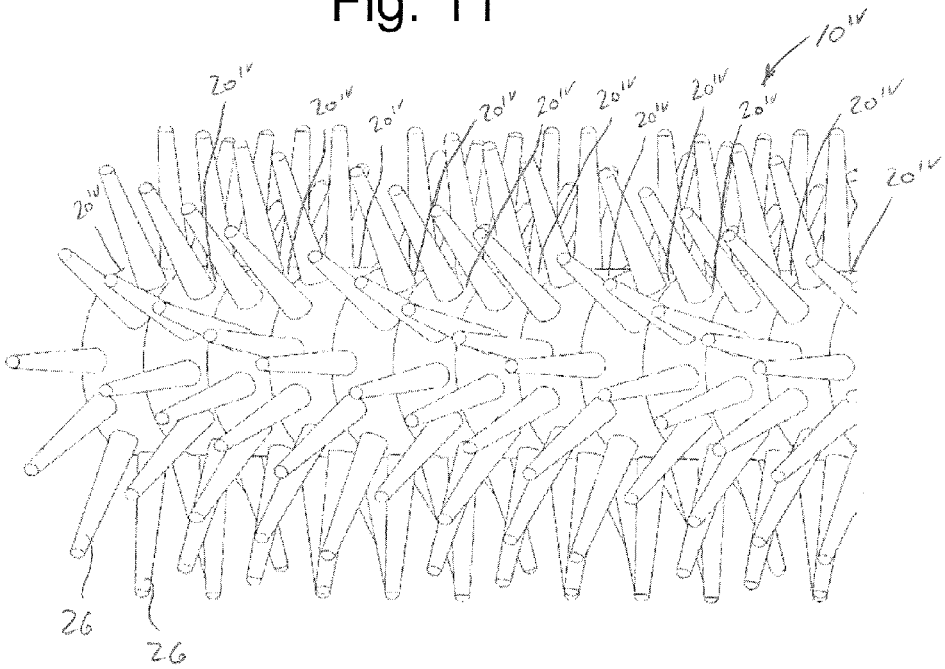
FIG. 12 is an assembled view of the cosmetic applicator brush of FIG. 11.

Referring to FIGS. 11 and 12, a cosmetic applicator brush $\mathbf{10}^{iv}$ in accordance with another embodiment of the invention will be described. The present embodiment is similar to the first embodiment accept that the body $\mathbf{22}^{iv}$ of each disc $\mathbf{20}^{iv}$ does not include a through bore. Instead, to connect the discs $\mathbf{20}^{iv}$, the projections 28 and indentations 30 fit tightly so that the discs $\mathbf{20}^{iv}$ are holding onto each other to form a brush without a rod. It is further possible to attach the individual discs with other mechanical or chemical means, such as glue, laser or ultrasonic welding and any other similarly embployed techniques while optionally employing the axial rod.

Figure 13:
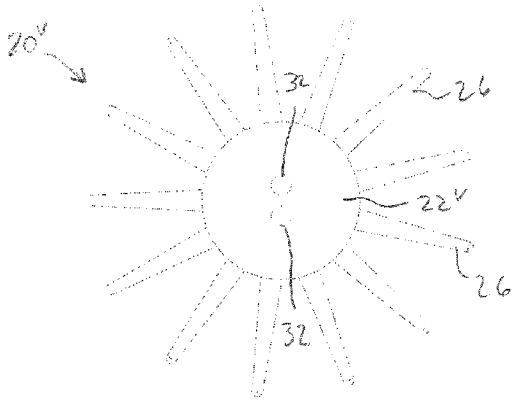
FIG. 13 is a top perspective view of an exemplary disc in accordance with another embodiment of the invention.
Figure 14:
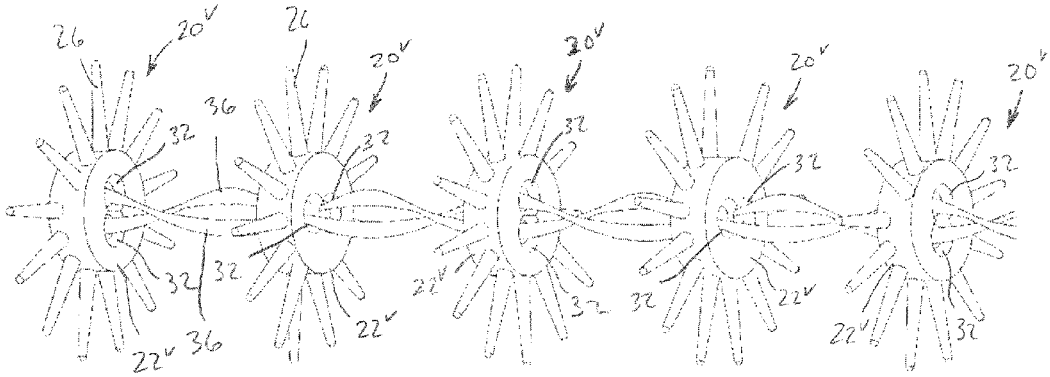
FIG. 14 is an exploded perspective view of a cosmetic applicator brush utilizing discs of FIG. 13.
Figure 15:
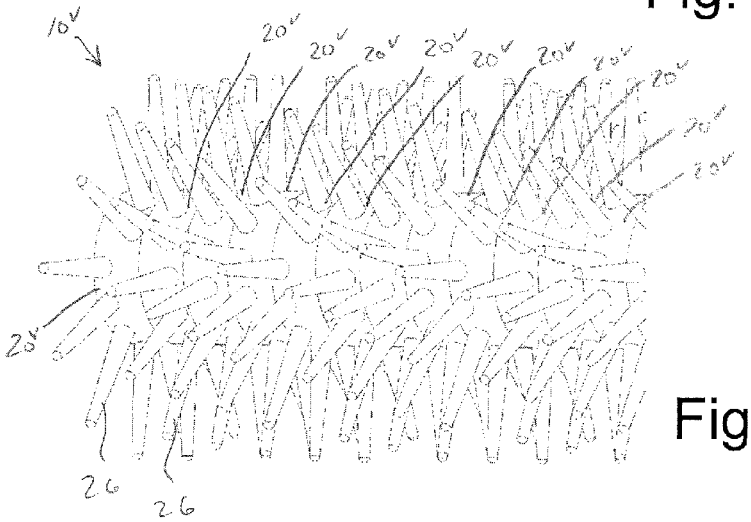
FIG. 15 is an assembled view of the cosmetic applicator brush of FIG. 14.

Referring to FIGS. 13-15, a cosmetic applicator brush 10$^{v}$ in accordance with another embodiment of the invention will be described. The present embodiment includes a plurality of stacked discs 20$^{v}$ which are interconnected to one another via a pair of wires 36, which may be separate wires or formed from a single wire folded and returned. Additionally, while wire is described herein, string or similar structures may be utilized. The body 22$^{v}$ of each disc 20$^{v}$ includes a pair of wire passages 32. As illustrated in FIG. 14, each wire 36 is passed through the respective wire passage 32 of successive discs 20$^{v}$. Once the pair of wires 36 is passed through the stacked discs 20$^{v}$, all the discs 20$^{v}$ are linked together and then they can be twisted to form a desired shape where each disc 20$^{v}$ has a finite angular offset compared to the disc 20$^{v}$ before and after. The shape of the passages 32 has no relation with how the angular offset is determined, instead the angular offset is determined by the twist of the wire 36 going through the passages 32 and therefore the passages 32 can be in any shape as desired. According to the angle, design, and material of the disc, appropriate material can be chosen for the wire, string or the like, for example, a deformable elastic material, which will enable changes in angular offset on demand. For example, the deformable elastic material includes materials made of stainless steel or any material.

Figure 16:
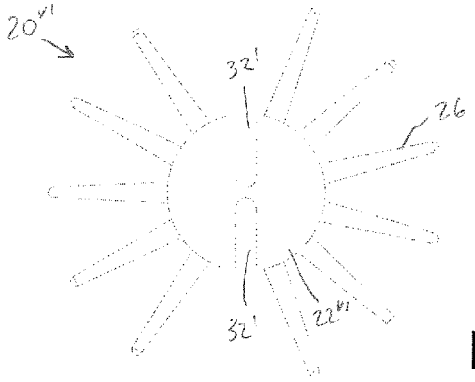
FIG. 16 is a top perspective view of an exemplary disc in accordance with another embodiment of the invention.
Figure 17:
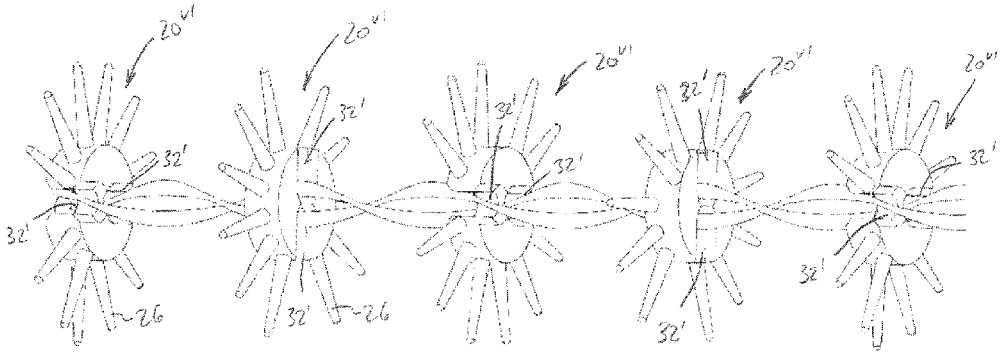
FIG. 17 is an exploded perspective view of a cosmetic applicator brush utilizing discs of FIG. 16.
Figure 18:
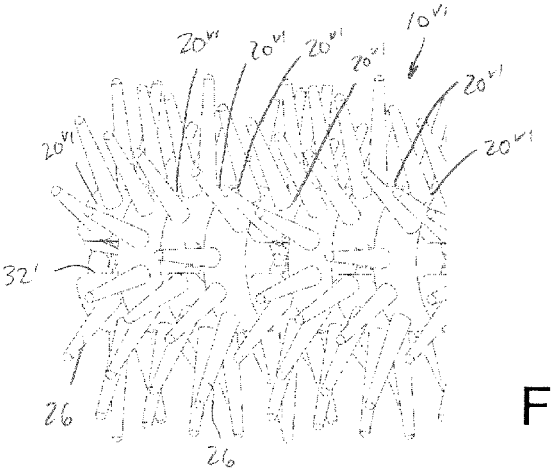
FIG. 18 is an assembled view of the cosmetic applicator brush of FIG. 17.

Referring to FIGS. 16-18, a cosmetic applicator brush 10$^{vi}$ in accordance with another embodiment of the invention will be described. The present embodiment is substantially the same as in the previous embodiment except that the passages 32' through the discs 20' extend to the outside surface of the disc body 22$^{vi}$. Such a configuration allows the wire 36 to enter before or after discs 20$^{vi}$ are in an assembled position. In all other aspects, the brush 10*vi* is the same as in the previous embodiment. It is further contemplated that one or more discs may have a closed passage 32 and an open passage 32'. The closed passage 32 serves as an anchor to hold the discs together while the open passage 32' can be used to determine angular offset between discs by having a shaped insert to guide each individual disc in formation.

Figure 19:
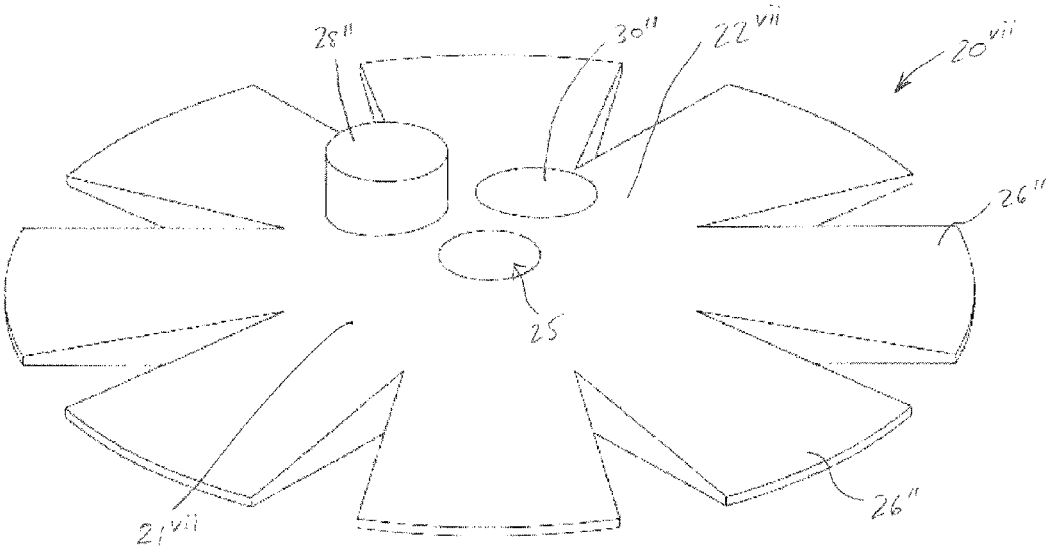
FIG. 19 is a top perspective view of an exemplary disc in accordance with another embodiment of the invention.
Figure 20:
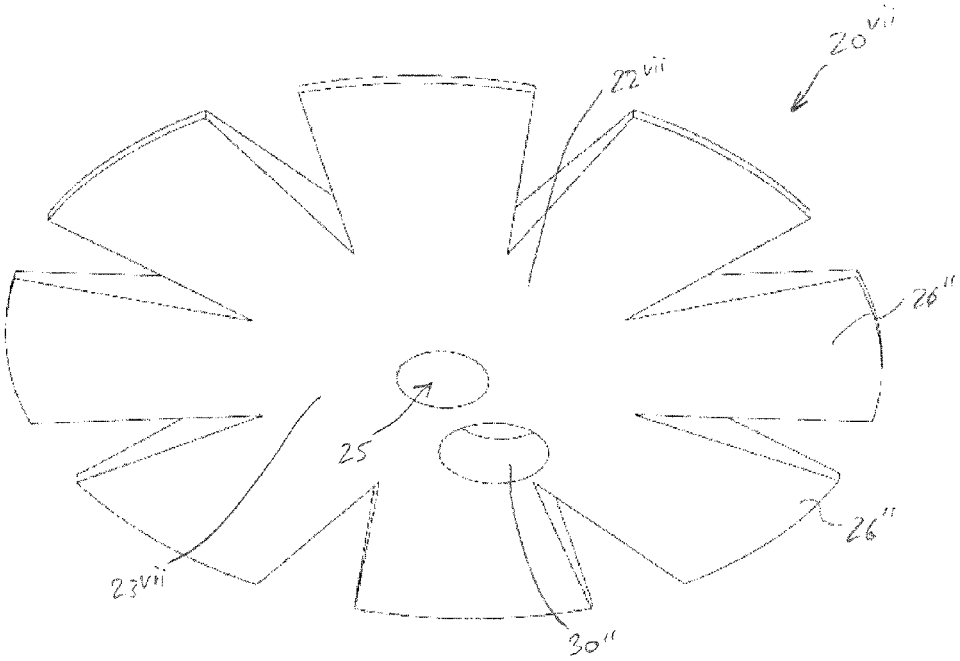
FIG. 20 is a bottom perspective view of the disc of FIG. 19.

FIGS. 19 and 20 illustrate an exemplary disc 20$^{vii}$ in accordance with another embodiment of the invention. In the present embodiment, a circular projection 28" extends from face 21$^{vii}$ of body 22$^{vii}$ while a corresponding indentation 30" is defined in the opposite face 23$^{vii}$. Again, the projections 28' and the indentations 30' are at an angular offset with respect to one another. In the present embodiment, the bristles 26" are formed by cutting shapes out of disc body 22$^{vii}$. Rectangular bristles 26" are illustrated, but any desired shapes may be cut into the disc body 22$^{vii}$ to form bristles 26" of any desired shape. It is understood that the term bristle as used herein includes any shape or structure extending radially outward to pick up the cosmetic and is not limited to the specific shapes or structures illustrated herein. The bristles may be of the same material as the disc body or of a different material and may be formed through any desired techniques including molding, double-shot molding, cutting, forming or like.

Figure 21:
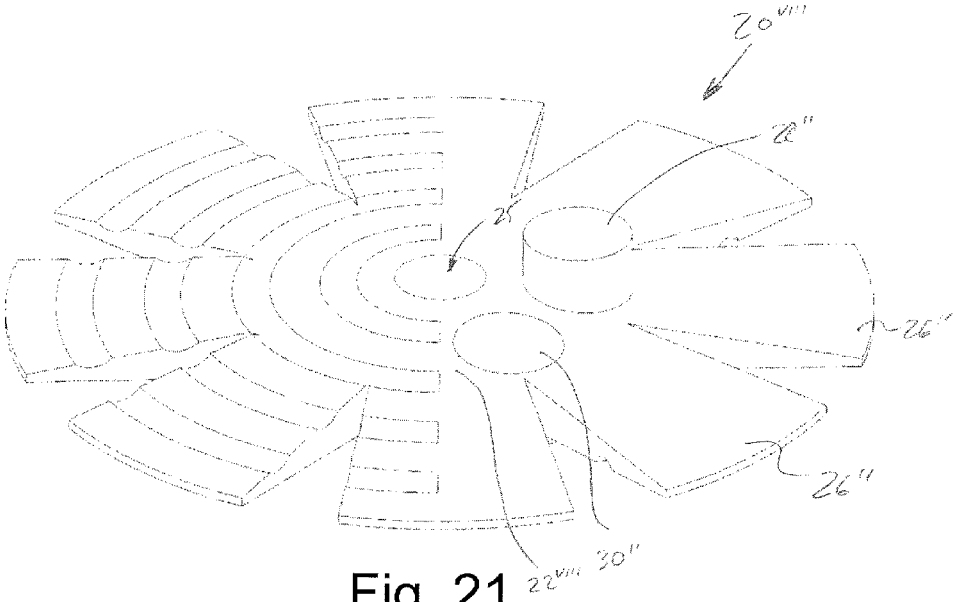
FIG. 21 is a top perspective view of an exemplary disc in accordance with another embodiment of the invention.
Figure 22:
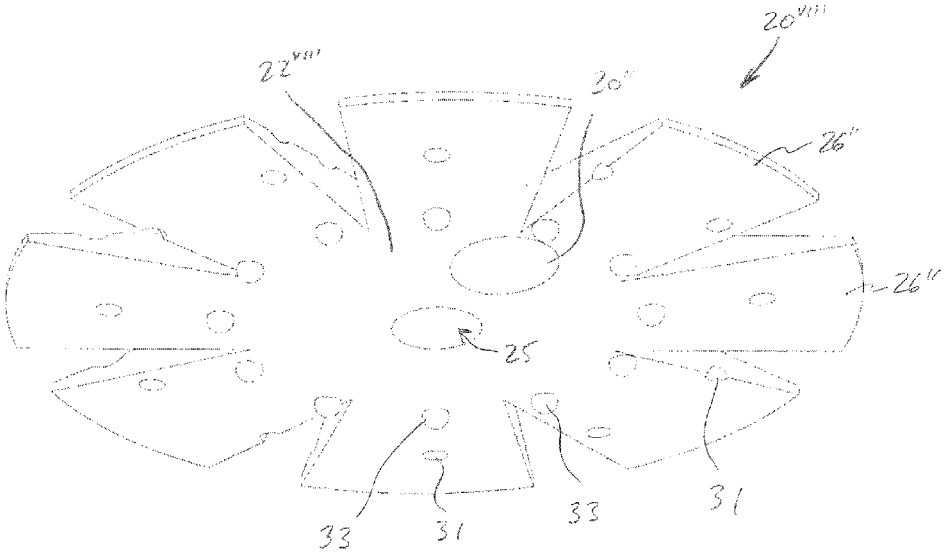
FIG. 22 is a bottom perspective view of the disc of FIG. 21.

Additionally, in the embodiment illustrated in FIGS. 19 and 20, the disc body 22$^{vii}$ is thicker toward the center of the disc and thinner toward outer edge of the disc. Variations of the disc body thickness can be altered to produce various desired effects. For example, the disc body 22$^{vii}$ can be thicker along the edge compared to the center in order to retain more mascara formula between the bristles 26". FIGS. 21 and 22 illustrate another embodiment of the disc 20$^{viii}$ wherein the disc body 22$^{viii}$ has a thickness which decreases and increases in pattern from the center toward the edge to create 'wavy' appearance or any other pattern if desired. Additionally, a variety of shapes and formation of features, for example, bumps 33 and recesses 31, may be added on the surface to enhance performance if so desired. In all other respects, the discs 20$^{vii}$ and 20$^{viii}$ may be stacked on a rod (not shown) to achieve a brush with a desired configuration. FIGS. 25(A)-(D) are assembled views of the cosmetic applicator brush of FIG. 14, where a plurality of stacked discs is interconnected to one another via a pair of wires. FIGS. 26(A)-(D) are assembled views of the cosmetic applicator brush of FIG. 17, where the passages through the discs extend to the outside surface of the disc body.

It is noted that while the shape of the disc in each example is circular, the invention is not limited to such and the disc body can have any shape desired.

These and other advantages of the present invention will be apparent to those skilled in the art from the foregoing specification. For example, the present invention provides a cosmetic applicator that is capable of providing excellent mascara makeup effect such as volumizing, curling, separation, and lengthening. In addition, the present invention provides a cosmetic applicator, where each disc has different colors, shapes and sizes, thereby creating a visually attractive cosmetic. Accordingly, it will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as defined in the claims.

What is claimed is:

1. A cosmetic applicator brush comprising:

a plurality of discs assembled relative to one another, the assembled discs forming a group, each disc having a body with a plurality of bristles and/or combs extending radially therefrom, wherein each disc body has wire passages extending therethrough and wire extends through the passages of the group of the plurality of discs to link the discs together and an amount of twist in the wire defines the angular relationship between adjacent discs, wherein the plurality of discs are linked, and the wire is twisted independently at both ends of the cosmetic applicator brush to form a desired shape, wherein the plurality of discs are made of plastic or rubber, and wherein the wire is made of metal or metallic materials.

2. The cosmetic applicator brush according to claim 1 wherein each disc body has a first face with a projection extending therefrom and an opposed second face with an indentation defined therein, wherein the projection and indentation are angularly offset from one another and the interaction of a projection of one disc with the indentation of an adjacent disc maintains the angular relationship between the adjacent discs.

3. The cosmetic applicator brush according to claim 2 wherein angular offset of the projection and the indentation of each disc is between 0° and 360°.

4. The cosmetic applicator brush according to claim 3 wherein the angular offset is the same for each of the discs.

5. The cosmetic applicator brush according to claim 3 wherein the angular offset is different for at least two of the discs.

6. The cosmetic applicator brush according to claim 2 wherein the interaction of the projection of one disc with the indentation of an adjacent disc maintains the adjacent discs interconnected to form the brush head.

7. The cosmetic applicator brush according to claim 6 wherein the discs are further secured to one another via welding and/or gluing.

8. The cosmetic applicator brush according to claim 1 wherein each of the discs has a through bore and a rod extends through the through bore of each of the discs, and wherein the rod and through bore are free of any keying elements.

9. The cosmetic applicator brush according to claim 8 wherein the through bores and the rod each have a circular configuration.

10. The cosmetic applicator brush according to claim 8 wherein the rod defines a cap end with a finished surface and a connecting surface opposite thereto, the connecting surface defining a projection or a recess configured to engage a recess or projection on a face of an adjacent disc.

11. The cosmetic applicator brush according to claim 1 wherein the bristles on adjacent discs define a twisted bristle path.

12. The cosmetic applicator brush according to claim 1 wherein the combs on adjacent discs define a straight comb path.

13. The cosmetic applicator brush according to claim 1 wherein at least one bristle includes a main portion and at least one secondary portion extending from the main portion.

14. The cosmetic applicator brush according to claim 1 wherein each disc has a body and the bristles are defined by cutting away portions of the body.

15. The cosmetic applicator brush according to claim 14 wherein the disc body varies in thickness from a central portion thereof to a circumferential portion thereof.

16. The cosmetic applicator brush according to claim 14 wherein the disc body varies in thickness from a central portion thereof to a circumferential portion thereof in a wavy pattern.

17. The cosmetic applicator brush according to claim 14 wherein the disc body includes a plurality of bumps and/or recesses defined thereon.

* * * * *